US006077393A

United States Patent [19]

Shannon et al.

[11] Patent Number: 6,077,393

[45] Date of Patent: Jun. 20, 2000

[54] SOFT TISSUE PRODUCTS HAVING HIGH STRENGTH

[75] Inventors: Thomas Gerard Shannon, Neenah; Nancy Sarsfield Clungeon, Manawa; Sheng Hsin Hu, Appleton, all of Wis.

[73] Assignee: Kimberly-Clark Worldwide, Inc., Neenah, Wis.

[21] Appl. No.: 09/190,317

[22] Filed: Nov. 12, 1998

[51] Int. Cl.[7] ..... D21H 17/45

[52] U.S. Cl. ..... 162/158; 162/111; 162/179; 162/164.6; 162/168.2; 428/153

[58] Field of Search ..... 162/158, 164.6, 162/179, 168.2, 111, 112; 428/152, 153

[56] References Cited

U.S. PATENT DOCUMENTS

| | | | |
|---|---|---|---|
| 4,940,513 | 7/1990 | Spendel | 162/112 |
| 4,959,125 | 9/1990 | Spendel | 162/158 |
| 5,354,425 | 10/1994 | Mackey et al. | 162/135 |
| 5,607,551 | 3/1997 | Farrington, Jr. et al. | 162/109 |
| 5,695,607 | 12/1997 | Oriaran et al. | 162/112 |
| 5,730,839 | 3/1998 | Wendt et al. | 162/111 |
| 5,746,887 | 5/1998 | Wendt et al. | 162/109 |
| 5,772,845 | 6/1998 | Farrington, Jr. et al. | 162/109 |
| 5,882,479 | 3/1999 | Oriaran et al. | 162/112 |
| 5,904,810 | 5/1999 | Schroeder et al. | 162/111 |

OTHER PUBLICATIONS

TAPPI Official Test Method T 494 om–88, "Tensile Breaking Properties Of Paper And Paperboard (Using Constant Rate Of Elongation Apparatus)," published by the TAPPI Press, Atlanta, Georgia, revised 1988, pp. 1–5.

*Primary Examiner*—Stanley S. Silverman
*Assistant Examiner*—José A. Fortuna
*Attorney, Agent, or Firm*—Gregory E. Croft

[57] ABSTRACT

Certain alkylamides and alkylimides, such as hydroxy alkylamides, which ordinarily act as softening agents and substantially reduce the tensile strength of the tissue sheet in accordance with the strength/softness curve, have been found to have a significantly lesser effect on the strength of tissue sheets which have been noncompressively dewatered and dried. As a result, soft uncreped throughdried tissue sheets can be made to have a higher strength:softness ratio by incorporating these chemicals into the furnish.

13 Claims, 2 Drawing Sheets

SOFT TISSUE PRODUCTS HAVING HIGH STRENGTH

BACKGROUND OF THE INVENTION

In the manufacture of tissue products such as facial tissue, bath tissue, paper towels, dinner napkins and the like, it is well known that strength and softness are inversely related. For a given tissue base sheet, increasing the softness of the sheet will generally decrease the tensile strength, particularly when the softness is increased through mechanical or chemical debonding. Creping is a good example of mechanical debonding which substantially weakens the sheet. The addition of debonders to the tissue making furnish is a common example of a chemical means for softening the sheet, but which also results in a weaker sheet. In either case the strength of the tissue sheet must be initially made stronger to counteract the strength degradation of the softening effect. This translates into higher costs for chemical strengthening agents or additional fibers.

Hence there is a need for a means for providing soft tissue sheets which has a less pronounced negative effect on the strength of the resulting sheet.

SUMMARY OF THE INVENTION

It has now been discovered that certain chemicals, some of which are used in the paper industry as opacifying agents, also act as softener/debonders. Surprisingly, however, it has been found that while these chemicals follow the traditional strength/softness relationship when used in conventional wet pressing processes, when added to the furnish of a tissue making process which uses non-compressive dewatering and drying, the adverse effect on the strength of the tissue sheet is greatly reduced.

Hence in one aspect, the invention resides in a non-compressively dewatered and dried tissue sheet comprising an amount of one or more alkylamide and/or alkylimide softening agents having at least one of the following structures:

(1)

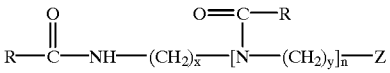

(2)

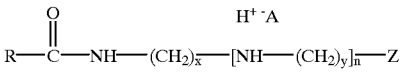

(3)

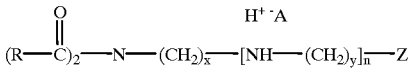

wherein R=any saturated or unsaturated fatty acid group having a chain length of 6 to 22 carbon atoms;

n=0,1;

x=to 6;

y=1to 6;

Z=H, OH; and

A=any anion of a strong or weak acid.

In another aspect, the invention resides in a method of making a soft and strong tissue sheet comprising:

(a) adding one or more alkylamide or alkylimide softening agents to an aqueous suspension of papermaking fibers and maintaining the resulting aqueous mixture of fibers and alkylamides at a temperature of from about 20° C. to about 70° C. for at least 10 minutes, said softening agent(s) having one or more of the following structures:

(1)

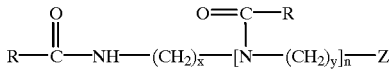

(2)

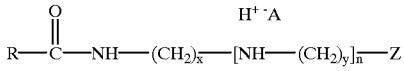

(3)

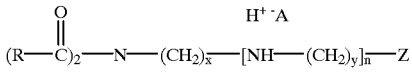

wherein R=any saturated or unsaturated fatty acid group having a chain length of 6 to 22 carbon atoms;

n=0,1;

x=1 to 6;

y=1 to 6;

Z=H, OH; and

A=any anion of a strong or weak acid;

(b) depositing the aqueous suspension of papermaking fibers onto a forming fabric to form a tissue web;

(c) non-compressively dewatering the web; and (d) non-compressively drying the web to form a soft tissue sheet.

Suitable commercially available alkylamides are sold under the trade name Reactopaque® 100, 102 and 115 by Sequa Chemical Company, Chester, S.C., which are sold as aqueous solutions. These three materials are believed to be blends of the alkylamides set forth in structural formulas (1) and (2) above. Reactopaque® 102 is about 20 weight percent solids, Reactopaque®100 is about 10 weight percent solids, and Reactopaque®115 is about 15 weight percent solids.

The amount of the alkylamide or alkylimide softening agent, on a solids basis, used to attain improved strength and softness can be from about 0.5 to about 30 pounds per metric ton of fiber, more specifically from about 2 to about 20 pounds per metric ton of fiber, and most specifically from 6 to about 15 pounds per metric ton of fiber. Preferred amounts are greater than the amounts recommended for purposes of improving opacity in writing papers and newsprint, which are the primary market for these materials.

In mixing the alkylamide and/or the alkylimide with the aqueous suspension of papermaking fibers, it is desirable to maintain the mixture in a heated condition for a period of time before forming the tissue web. The temperature of the aqueous fiber suspension/alkylamide mixture can be from about 20° C. to about 90° C., more specifically from about 30° C. to about 80° C., and still more specifically from about 40° C. to about 70° C. The length of time that the mixture is maintained at the elevated temperature can be about 5 minutes or longer, more specifically from about 5 minutes to about 40 minutes, and still more specifically from about 5 minutes to about 20 minutes.

The alkylamides and/or alkylimide softening agents can be mixed with the entire furnish used to make the tissue or they can be added to select portions of the furnish, such as the furnish of one or more layers of a layered tissue. Alternatively, the amounts of the softening agents can be the same or different in each of the furnish layers.

The GMT (Geometric Mean Tensile strength expressed as grams-force per 3 inches of sample width) of the tissue sheets of this invention can be about 600 or greater, more specifically about 700 or greater, still more specifically about 800 or greater, still more specifically about 1000 or greater, and still more specifically from about 700 to about 1300. GMT is computed from the peak load values of the MD (machine direction) and CD (cross-machine direction) tensile curves, which are obtained under laboratory conditions of 23.0+/−1.0 degrees Celcius and 50.0+/−2.0 percent relative humidity and only after the sheet has equilibrated to the testing conditions for a period of not less than four hours. Testing is done on a constant rate of elongation tensile testing machine. Specimen width is 3 inches. Jaw span (the distance between the jaws, sometimes referred to as gauge length) is 2.0 inches (50.8 mm.) Crosshead speed is 10 inches per minute (254 mm/min.) A load cell/full scale load is chosen so that the majority of peak load results fall between 20 and 80 percent of the full scale load. In particular the results described here were produced on an Instron 1122 tensile frame connected to a Sintech data acquisition and control system utilizing IMAP software running on a '486 Class' personal computer. This data system records at least 20 load and elongation points per second.

The MD Slope of the tissue sheets of this invention can be about 10 or less, more specifically about 9 or less, and still more specifically from about 4 to about 8. The MD Slope is the two parameter least squares line regression coefficient (sometimes referred to as slope) obtained from the tensile load/elongation curve for all points falling between a load of 70 grams and 157 grams during the ascending part of the curve. The regression coefficient is multiplied by the jaw span and divided by the specimen width to normalize the result, resulting in the final MD Slope value. The MD Slope values may be obtained from the MD tensile curves utilized for the GMT calculation; MD Slope utilizes an identical 3 inch specimen width and two inch jaw span. The units for MD Slope are kilograms per 3 inches (7.62 centimeters), but for convenience, the MD Slope values are hereinafter referred to without units.

The MD Stiffness Factor of the products of this invention can be about 100 or less, more specifically about 80 or less, and still more specifically from about 40 to about 80. The MD Stiffness Factor is calculated by multiplying the MD Slope by the square root of the Caliper (measured as described below). The units of the MD Stiffness Factor are (kilograms per 3 inches) microns$^{0.5}$, but for simplicity the values of the MD Stiffness Factor are hereinafter referred to without units.

For purposes of calculating the MD Stiffness Factor, the Caliper is the thickness of a single sheet, expressed in microns. It is measured under laboratory conditions of 23.0+/−1.0 degrees Celcius and 50.0+/−2.0 percent relative humidity and only after the sheet has equilibrated to the testing conditions for a period of not less than four hours. The micrometer used for carrying out this measurement is an Emveco model 200-A with flat ground, circular pressure foot and anvil and with factory modifications to meet the following specifications: a round pressure foot diameter of 56.42 millimeters (equating to an area of 2500 square millimeters; pressure foot loading of 2.00 kilopascals; 0 to 7.6 mm test capacity; readout resolution of 0.001 millimeters; repeatability of 0.001 millimeters;

linearity of +/−0.25 percent; dwell time of 3.0+/−1.0 seconds; lowering rate of 0.8 millimeters +/−0.1 per second; and pressure foot and anvil to be parallel within 0.001 mm.

The MD Stiffness Factor: GMT ratio, expressed in kg-microns$^{0.5}$/gm, for tissue sheets in accordance with this invention can be about 0.077 or less, more specifically about 0.060 or less, more specifically about 0.050 or less, and more specifically from about 0.030 to about 0.070, and still more specifically from about 0.050 to about 0.070.

EXAMPLES

Example 1

Figure 1:
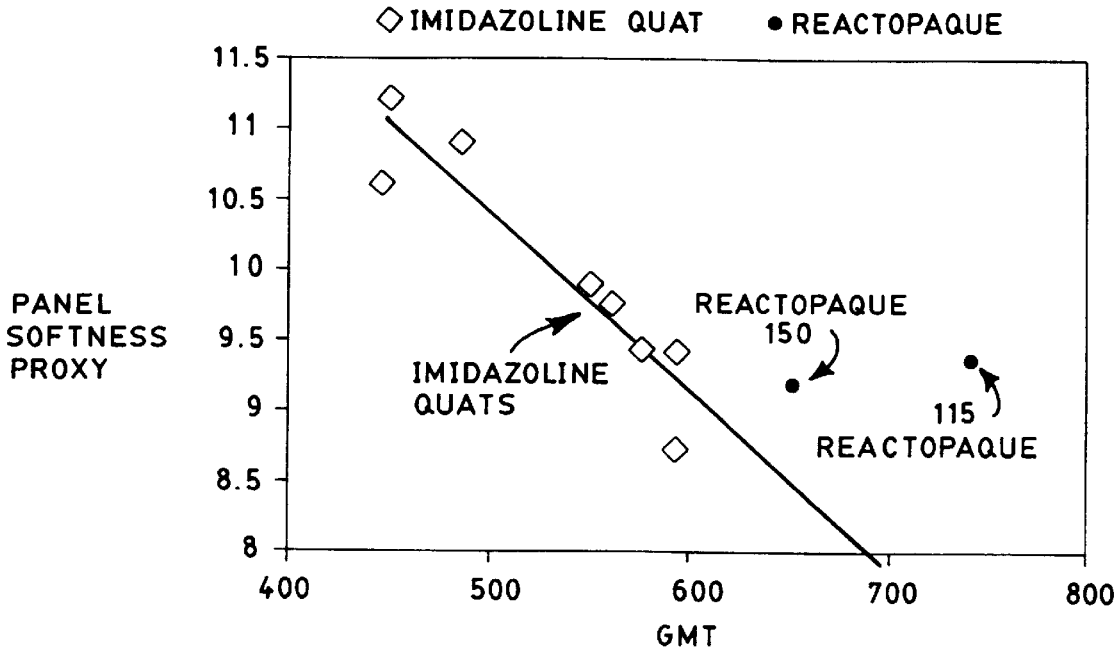
FIG. 1 is a plot of softness versus strength for non-compressively dewatered and dried tissue sheets comparing the strength loss effect of conventional (imidazoline quaternary) softening agents with that of certain alkylamide softening agents in accordance with this invention. As shown, the imidazoline quaternaries follow the typical strength/softness curve, while the alkylamides of this invention are off of the curve and represent increased strength for a given level of softness.
Figure 2:
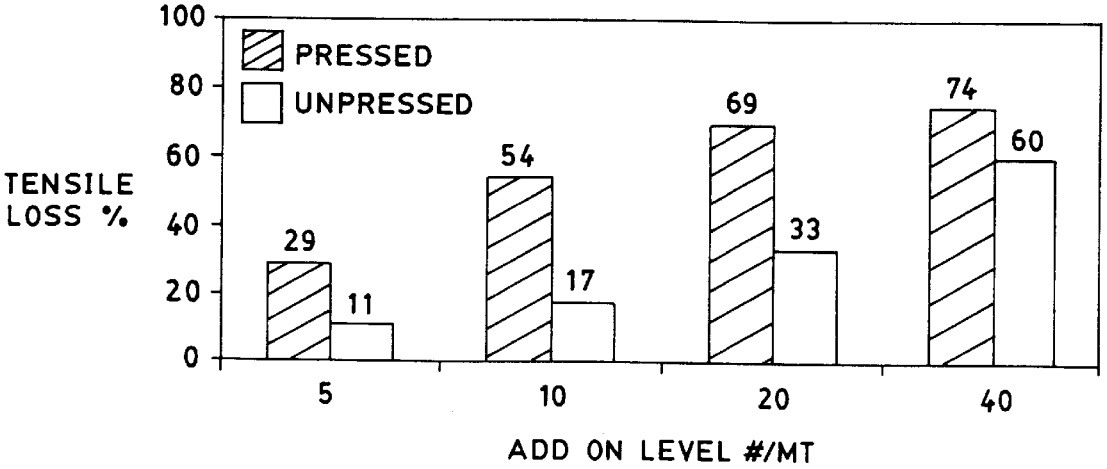
FIG. 2 is a bar chart comparing the percent tensile loss for pressed and unpressed handsheets as a function of the add-on amount of certain alkylamide softening agents in accordance with this invention. As shown, at the same wet end add-on amounts, the non-compressively dewatered sheets had substantially less strength loss than the wet-pressed sheets.
Figure 3:
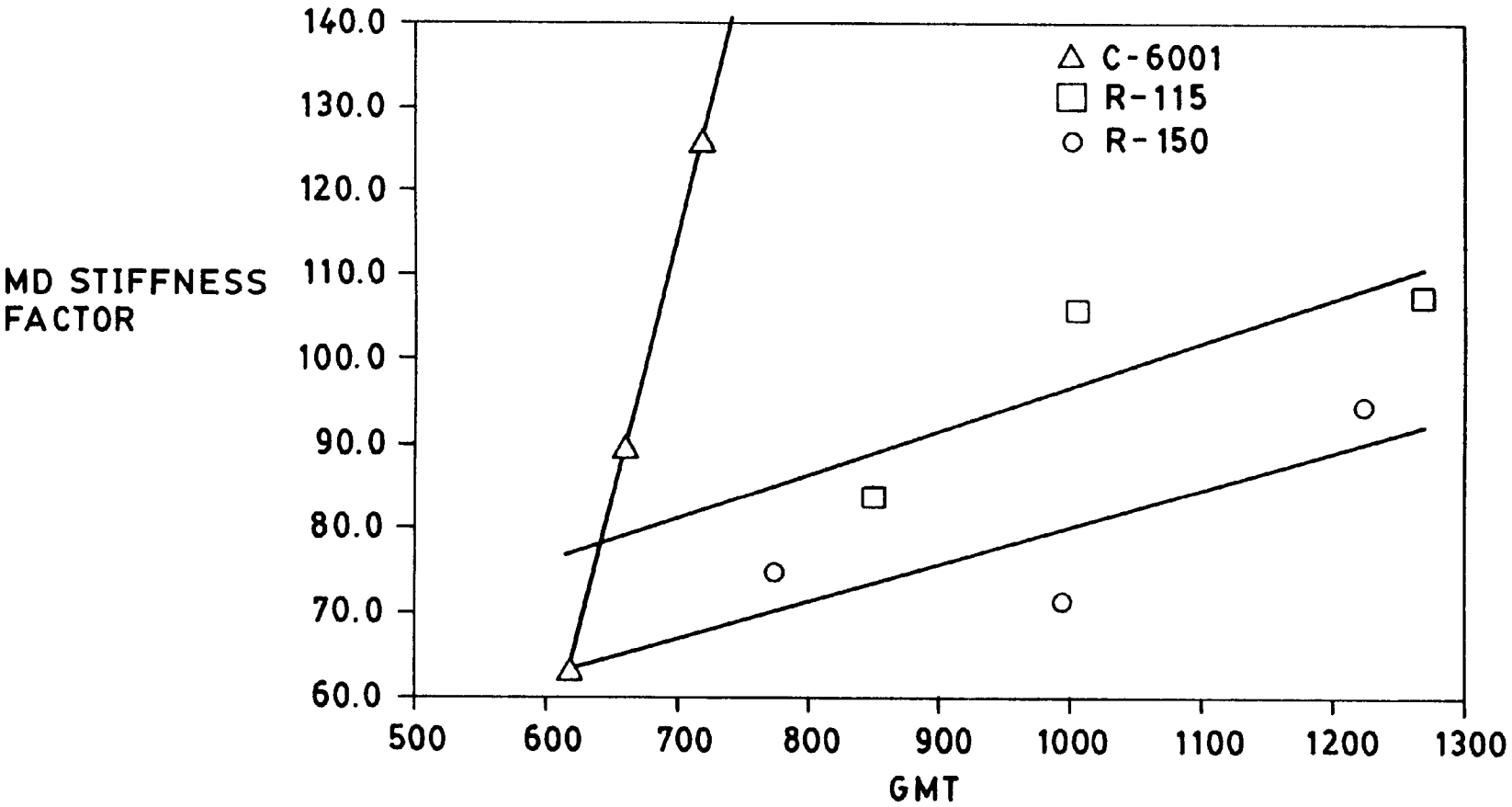
FIG. 3 is a plot of the MD Stiffness Factor versus GMT for several tissue base sheets (not converted into final product form), illustrating how steeply the curve rises for the oleyl imidazoline quaternaries as compared to the relatively flat curves for tissue sheets made in accordance with the alkylamides of this invention (R-115 and R-150). The flatter curves illustrate how greatly increased strength can be achieved with a relatively small increase in stiffness (lower loss of softness). Also noteworthy in FIG. 3 is the impact of adding a relatively small amount of alkylamide softening agent in conjunction with an oleyl imidazoline softening agent. An almost 50 percent reduction in stiffness factor is seen with addition of 2 pounds of the alkylamide per metric ton of fiber.

(Control).

A one-ply, non-layered, uncreped throughdried tissue basesheet was made generally in accordance with U.S. Pat. No. 5,607,551 issued March 4, 1997 to Farrington et al. entitled "Soft Tissue", which is herein incorporated by reference. More specifically, 60 pounds (oven dry basis) of eucalyptus hardwood kraft fiber and 40 pounds (oven dry basis) of northern softwood kraft fiber were dispersed in a pulper for 30 minutes at a consistency of 3 percent. The thick stock slurry was then passed to a machine chest and diluted to a consistency of 1 percent. To the machine chest was added 182 grams (8.8 pounds per metric ton of dry fiber) of a commercially available dry strength resin, Parez 631-NC. The dry strength resin was added as a 6 percent aqueous solution. The stock was further diluted to approximately 0.1 percent consistency prior to forming. The formed web was non-compressively dewatered and rush transferred to a transfer fabric traveling at a speed about 25 percent slower than the forming fabric. The web was then transferred to a throughdrying fabric, dried and calendered. The total basis weight of the resulting sheet was 16 pounds per 2880 ft$^2$.

Example 2

(Invention).

A single-ply, non-layered uncreped throughdried tissue basesheet was made as described in Example 1, except the fibers were initially dispersed in a pulper for 5 minutes at a consistency of 3 percent. The temperature of the water in the pulper was raised to 120° F. (49° C.) prior to addition of the pulp. 275 grams of a 15 percent aqueous solution (41.3 grams dry basis, 2 pounds per metric ton of dry fiber) of a commercially available alkylamide softening agent (Reactopaque® 115 manufactured by Sequa Chemical Company) was added to the pulper and the pulp was allowed to disperse for 25 additional minutes.

Example 3

(Invention).

Same as Example 2, except that 825 grams of Reactopaque 115 (123.9 grams dry basis, 6 pounds per metric ton of dry fiber) was added to the pulper.

Example 4

(Invention).

Same as Example 2, except that 2063 grams of Reactopaque 115 (309.5 grams dry basis, 15 pounds per metric ton of dry fiber) was added to the pulper.

Example 5

(Conventional softening agent).

Same as Example 1, except that after the addition of the Parez dry strength resin to the machine chest, 41.3 grams (2 pounds per metric ton dry fiber) of a commercially available quaternary ammonium oleyl imidazoline softening agent (C-6001, Witco Corporation) was added. The softening agent was added as a 4 percent aqueous solution.

Example 6

(Conventional softening agent):

Same as Example 5, except that 82.6 grams of the oleyl imidazoline softening agent (4 pounds per metric ton of fiber) was added to the machine chest as a 4 percent aqueous solution.

Example 7

(Conventional softening agent).

Same as Example 5, except that 125 grams of the oleyl imidazoline softening agent (6 pounds per metric ton of dry fiber) was added to the machine chest as a 4 percent aqueous solution.

The tissues produced by Examples 1–7 were tested for softness by a trained sensory panel and for geometric mean tensile (GMT) strength, which is expressed as grams-force per 3 inches of sample width. The add-on level (Level) of the softening agent is expressed as pounds per metric ton of fiber on a dry basis. The results are set forth in TABLE 1 below:

The results of TABLE 1 illustrate that the alkylamide softening agents of this invention can attain equivalent softness at greater strength than the oleyl imidazoline softening agents.

Example 8

(Control—Creped/Wet-pressed).

A two-ply, wet-pressed bath tissue having a basis weight of 19 pounds per 2880 $ft^2$. was made in a conventional manner. More specifically, 60 pounds (oven dry basis) of eucalyptus hardwood kraft fiber and 40 pounds (oven dry basis) of northern softwood kraft fiber were dispersed in a pulper for 30 minutes at a consistency of 3 percent. The thick stock slurry was then passed to a machine chest and diluted to a consistency of 1 percent. To the machine chest was added 10.3 grams (0.5 pounds per metric ton of dry fiber) of a commercially available wet strength resin, Parez 631-NC, and 41.3 grams (2 pounds per metric ton of dry fiber) of a commercially available dry strength resin, Redibond 2005, and 49.6 grams (2.4 pounds per metric ton of dry fiber) of a commercially available imidazoline softening agent (C-6027 from Witco Corporation). The stock was further diluted to about 0.1 % consistency prior to forming, dewatering, drying and creping of the tissue web, which was plied together with a like web and calendered to form the final two-ply tissue product.

Example 9

(Hydroxy alkylamide/wet-pressed).

Same as Example 8, except that 163.2 grams dry basis (8 pounds per metric ton of dry fiber) of a commercially available alkylamide softening agent, Reactopaque 102, was added to the pulper.

Example 10

(Uncreped Throughdried Control).

A one-ply, non-layered, uncreped throughdried tissue basesheet was made generally in accordance with U.S. Pat. No. 5,607,551 issued Mar. 4, 1997 to Farrington et al. entitled "Soft Tissue", which is herein incorporated by reference. More specifically, 50 pounds (oven dry basis) of eucalyptus hardwood kraft fiber and 50 pounds (oven dry

TABLE 1

| Example | Softening Agent | Level | GMT | Panel Softness | Strength loss vs. Control |
|---|---|---|---|---|---|
| 1 (Control) | none | 0 | 1641 | — | — |
| 2 (Invention) | hydroxy alkylamide (Reactopaque ® 115) | 2 | 1268 | — | 22.7 |
| 3 (Invention) | hydroxy alkylamide (Reactopaque ® 115) | 6 | 1005 | — | 38.9 |
| 4 (Invention) | hydroxy alkylamide (Reactopaque ® 115) | 15 | 851/740 | 9.4 | 48.4 |
| 5 (Conventional debonder) | oleyl imidazoline (C-6001) | 2 | 716/600 | 9.1 | 56.6 |
| 6 (Conventional debonder) | oleyl imidazoline (C-6001) | 4 | 660/540 | 10.0 | 60.0 |
| 7 (Conventional debonder) | oleyl imidazoline (C-6001) | 6 | 618/490 | 10.8 | 62.5 |

Note: The first GMT value listed is for the base sheet, while the second value is for the converted bath tissue product, which has been calendered.

basis) of northern softwood kraft fiber were dispersed in a pulper for 30 minutes at a consistency of 3 percent. The thick stock slurry was then passed to a machine chest and diluted to a consistency of 1 percent. The stock was further diluted to approximately 0.1 percent consistency prior to forming. The formed web was non-compressively dewatered and rush transferred to a transfer fabric traveling at a speed about 25 percent slower than the forming fabric. The web was then transferred to a throughdrying fabric and dried. The total basis weight of the resulting sheet was 16 pounds per 2880 $ft^2$.

Example 11

(Invention).

A single-ply, non-layered uncreped through dried tissue basesheet was made as described in Example 10 with the exception that 165.2 grams dry basis (8 pounds per metric ton of dry fiber) of a commercially available softening agent, Reactopaque 102, was added to the pulper.

The tissue products of Examples 8–11 were tested for GMT strength and the results are set forth in TABLE 2. As above, the add-on level (Level) of the softening agent is expressed as pounds per metric ton of fiber on a dry basis.

TABLE 2

| Example | Method | Alkylamide Softening Agent | Level | GMT | Strength Loss |
|---|---|---|---|---|---|
| 8 | wet-press | none | 0 | 1391 | — |
| 9 | wet-press | yes | 8 | 613 | 55.9 |
| 10 | throughdried | none | 0 | 950 | — |
| 11 | throughdried | yes | 8 | 840 | 11.6 |

The results of TABLE 2 illustrate that in a conventional wet-pressing process the use of alkylamide softening agents causes significant debonding and weakening of the sheet with a 55.9 percent loss in tensile strength. However, in a process not involving compressive dewatering, the use of alkylamide softening agents in accordance with this invention demonstrate significantly less debonding and weakening of the sheet. In the example above only a 11.6 percent tensile loss was observed for the same level of addition.

Examples 12–22.

To further illustrate the unique combination of softness and strength attained using the alkylamide softening agents in accordance with this invention, throughdried tissue basesheets were made as described above in Example 10, but using different amounts of softening agents. The GMT, MD Max Slope, and MD Stiffness Factor were measured for each sample. The results are summarized in TABLE 3 below. As above, the add-on level (Level) of the softening agent is expressed as pounds per metric ton of fiber on a dry basis. All of the samples containing additives designated as "R-115" or "R-150" are in accordance with this invention.

TABLE 3

| Example | Softening Agent | Level | GMT | MD Slope | MD Stiffness Factor | MD Stiffness Factor: GMT Ratio (Kg-microns$^{0.5}$)/gm |
|---|---|---|---|---|---|---|
| 12 | none | 0 | 1641 | 16.31 | 186 | 0.113 |
| 13 | C-6001 | 2 | 716 | 8.67 | 99 | 0.138 |
| 14 | C-6001 | 4 | 660 | 6.16 | 70 | 0.106 |
| 15 | C-6001 | 6 | 618 | 4.32 | 49 | 0.079 |
| 16 | R-115 | 2 | 1268 | 7.45 | 85 | 0.067 |
| 17 | R-115 | 6 | 1005 | 7.32 | 83 | 0.082 |
| 18 | R-115 | 15 | 851 | 5.78 | 66 | 0.077 |
| 19 | R-150 | 2 | 1224 | 6.54 | 75 | 0.061 |
| 20 | R-150 | 4 | 995 | 4.93 | 56 | 0.056 |
| 21 | R-150 | 6 | 775 | 5.16 | 59 | 0.076 |
| 22 | 2 pounds R-115 + 4 pounds C-6001 | 6 | 683 | 3.80 | 43 | 0.063 |

These results illustrate the unique combination of strength and softness (as measured by the MD Slope and the MD Stiffness Factor) achieved using tissues containing the alkylamides of this invention.

It will be appreciated that the foregoing examples, given for purposes of illustration, shall not be construed as limiting the scope of this invention, which is defined by the following claims and all equivalents thereto.

We claim:

1. A non-compressively dewatered and dried tissue sheet comprising an amount of one or more alkylamide and/or alkylimide softening agents having at least one of the following structure(s):

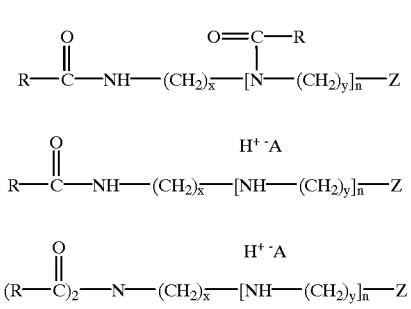

(1)

(2)

(3)

wherein R=any saturated or unsaturated fatty acid group having a chain length of 6 to 22 carbon atoms;

n=0,1;

x=1 to 6;

y=1 to 6;

Z=H or OH; and

A=any anion of a strong or weak acids wherein the softening agent imparts a substantially lower percent tensile loss to non-compressibly dried handsheets than to comparable wet-pressed handsheets at an add-on level of from 5 to 20 pounds per metric ton of dry fiber.

2. The tissue of claim 1 wherein the amount of the softening agent, on a solids basis, is from about 0.5 to about 20 pounds per metric ton of dry fiber.

3. The tissue of claim 1 wherein the amount of the softening agent, on a solids basis, is from about 2 to about 20 pounds per metric ton of dry fiber.

4. The tissue of claim 1 wherein the amount of the softening agent, on a solids basis, is from 6 to about 15 pounds per metric ton of dry fiber.

5. The tissue of claim 1 wherein Z=OH.

6. A non-compressively dewatered and dried tissue sheet comprising an amount of an alkylamide softening agent having the following structure:

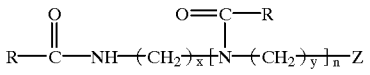

wherein R=any saturated or unsaturated fatty acid group having a chain length of 6 to 22 carbon atoms;

n=0,1;

x=1 to 6;

y=1 to 6; and

Z=H or OH, wherein the softening agent imparts a substantially lower percent tensile loss to non-compressibly dried handsheets than to comparable wet-pressed hand sheets at an add-on level of from 5 to 20 pounds per metric ton of dry fiber.

7. The tissue of claim 6 wherein the alkylamide has the following structure:

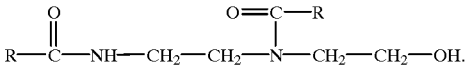

8. A non-compressively dewatered and dried tissue sheet comprising an amount of an alkylamide softening agent having the following structure:

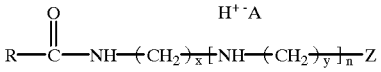

wherein R=any saturated or unsaturated fatty acid group having a chain length of 6 to 22 carbon atoms;

n=0,1;

x=1 to 6;

y=1 to 6;

Z=H or OH; and

A=any anion of a strong or weak acid, wherein the softening agent imparts a substantially lower percent tensile loss to non-compressibly dried handsheets than to comparable wet-pressed handsheets at an add-on level of from 5 to 20 pounds per metric ton of dry fiber.

9. The tissue of claim 8 wherein the alkylamide has the following structure:

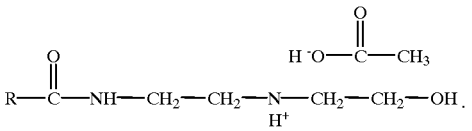

10. The tissue of claim 9 further comprising an alkylamide softening agent having the following structure:

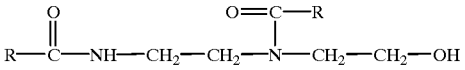

wherein R=a saturated or unsaturated fatty acid alkyl group having a chain length of 6 to 22 carbon atoms.

11. A non-compressively dewatered and dried tissue sheet comprising an amount of an alkylimide softening agent having the following structure:

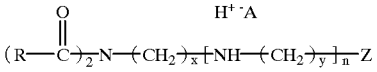

wherein R=any saturated or unsaturated fatty acid group having a chain length of 6 to 22 carbon atoms;

n=0,1;

x=1 to 6;

y=1 to 6;

Z=H or OH; and

A=any anion of a strong or weak acid, wherein the softening agent imparts a substantially lower percent tensile loss to non-compressibly dried handsheets than to comparable wet-pressed handsheets at an add-on level of from 5 to 20 pounds per metric ton of dry fiber.

12. The tissue of claim 11 wherein the alkylimide softening agent has the following structure:

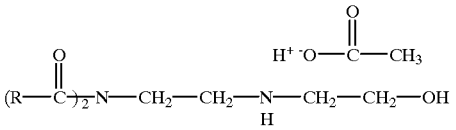

13. A method of making a soft and strong tissue sheet comprising:

(a) adding an amount of one or more softening agents to an aqueous suspension of papermaking fibers and maintaining the resulting aqueous mixture of fibers and softening agent(s) at a temperature of from about 40° C. to about 70° C. for at least 5 minutes, said softening agent(s) having one or more of the following structures:

(1)

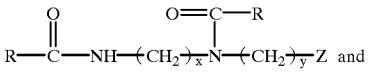

(2)

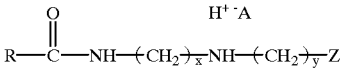

(3)

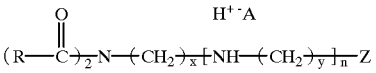

wherein R=any saturated or unsaturated fatty acid group having a chain length of 6 to 22 carbon atoms;

x=1 to 6;

y=1 to 6;

Z=H, OH; and

A=an anion of any strong or weak acid;

(b) depositing the aqueous suspension of papermaking fibers onto a forming fabric to form a tissue web;

(c) non-compressively dewatering the web; and (d) non-compressively drying the web to form a soft tissue sheet, wherein the softening agent imparts a substantially lower percent tensile loss to non-compressibly dried handsheets than to comparable wet-pressed handsheets at an add-on level of from 5 to 20 pounds per metric ton of dry fiber.

* * * * *